United States Patent [19]

Beermann

[11] 4,180,908

[45] Jan. 1, 1980

[54] GROOVING TOOL

[75] Inventor: Ewald H. Beermann, Solingen, Fed. Rep. of Germany

[73] Assignee: Martor-Argentax E. H. Beermann K.G., Solingen, Fed. Rep. of Germany

[21] Appl. No.: 878,077

[22] Filed: Feb. 14, 1978

[30] Foreign Application Priority Data

Feb. 14, 1977 [DE] Fed. Rep. of Germany ..... 2706148
Sep. 3, 1977 [DE] Fed. Rep. of Germany ..... 2739798

[51] Int. Cl.[2] ..... B26B 3/00

[52] U.S. Cl. ..... 30/279 R; 30/287; 30/293; 30/299

[58] Field of Search ..... 30/279 R, 287, 299, 30/293, 286

[56] References Cited

U.S. PATENT DOCUMENTS

| | | | |
|---|---|---|---|
| 611,408 | 9/1898 | Frueh | 30/287 |
| 1,915,636 | 6/1933 | Wendelken | 30/287 |
| 1,956,275 | 4/1934 | Cook | 30/299 |
| 1,995,887 | 3/1935 | Kimball | 30/289 |
| 2,038,884 | 4/1936 | Chalmer | 30/287 |
| 2,650,532 | 9/1953 | Moldowan | 30/299 |
| 3,596,356 | 8/1971 | O'Neal | 30/279 |
| 3,902,042 | 8/1975 | Goldfarb et al. | 30/286 |

FOREIGN PATENT DOCUMENTS

| | | | |
|---|---|---|---|
| 1190233 | 3/1959 | France | 30/286 |
| 575574 | 9/1956 | United Kingdom | 30/299 |

*Primary Examiner*—Robert L. Spruill
*Assistant Examiner*—J. T. Zatarga
*Attorney, Agent, or Firm*—Montague & Ross

[57] ABSTRACT

A grooving tool has a support provided with a handle formed on its lower surface with a substantially flat sliding face and having a pair of generally parallel slots opening at this face and extending in a predetermined direction. A blade is secured in each of the two slots with portions of the blades extending beyond the face and the cutting edges of the blades forming a vertex in projection in the predetermined direction on a plane perpendicular to this direction. The parts of the support forming the lower surface can be displaceable relative to the blades to vary the spacing between the vertex and the surface for a different depth of cut. The tool can be drawn along a workpiece such as a board of insulating material so as to cut in it a very neat groove by excising a strip which may be of triangular section if the blades are planar or of semicircular section if the blades have curved lower ends.

13 Claims, 11 Drawing Figures

GROOVING TOOL

FIELD OF THE INVENTION

The present invention relates to a grooving tool. More particularly this invention concerns a manually operable tool used for forming a groove in soft board material such as insulating board.

BACKGROUND OF THE INVENTION

In construction practices when using insulating board normally formed of cellulosic or similar materials, or when working with plaster board, it is frequently necessary to form a groove in such a board for the installation of wiring or the like. This is typically done on the job by laying a straightedge on a face of the board to be grooved, then cutting a slot with a razor knofe along the straightedge. Thereupon the straightedge is moved and another such slot is cut and the material between the two parallel slots is picked out.

Such an operation has several disadvantages. First of all the groove thus produced is frequently very messy. It is almost impossible to produce a groove of uniform cross-sectional dimension. Another difficulty is that frequently an inexperienced worker cuts all the way through the board, thereby marring the other side which is normally the exposed side in the finished job.

It has been suggested to use a router or the like for the formation of such a groove, but this method entails the use of relatively complex and expensive equipment which normally cannot be hand-powered.

OBJECTS OF THE INVENTION

It is therefore an object of the present invention to provide a grooving tool for forming a groove in insulating board, plaster board or the like in a single operation.

Yet another object is to provide such a tool which will surely and acurately produce a groove of uniform section and which can be used in a very simple manner.

Yet another object is the provision of such a grooving tool which can be adjusted to produce grooves of different cross-sectional dimensions and/or shapes.

SUMMARY OF THE INVENTION

These objects are attained according to the present invention in a grooving tool having a support forming a substantially flat bearing surface and formed with a pair of generally parallel slots opening at the surface and extending in a predetermined direction. A pair of blades each having a cutting edge is secured on the support with portions of the blades extending beyond the surface and with the cutting edges forming a vertex in projection in the predetermined direction on a plane perpendicular to this direction. A handle is provided on this support so that the tool can be displaced in the predetermined direction on a workpiece with the cutting edges excising a strip from the workpiece. The bearing surface according to this invention is formed by at least three points and preferably by at least two strips. Thus the support can move sled-fashion along the workpiece with the blades engaged therein, and it is possible to produce in a single path a very neat groove of absolutely uniform cross section, without risking piercing through the goods as the depth of cut will automatically be unvarying.

According to this invention the blades are staggered or offset to each other in the working direction, and in addition the cutting edges are inclined relative to the lower surface of the tool support, preferably being inclined back and away from this surface in the direction in which the tool is normally employed. Thus the tool will very easily slice through the workpiece.

According to further features of this invention the exposed portions of the blades may be curved so that together they form in projection on the above-mentioned plane a semicircle, there-by making a generally semicylindrical cut out. When thus shaped it is a relatively easy matter to mount wiring and even small piping in the groove thus formed.

The blades according to this invention are normally, however, planar and formed of razor-type steel. Thus the groove normally formed is V-shaped. When the blades overlap slightly in projection in the direction of use on a plane perpendicular to the direction of use the piece being cut out will very surely be excised each and every time. It is also possible to use the two blades offset by 90° relative to each other in arrangements where the board being grooved has on the outer face at least a skin. This is typical in arrangements using insulating board having an aluminum-foil skin. The blades in such an arrangement are set so that they do not overlap, but merely meet in projection on the above-mentioned plane. Furthermore this meeting point or vertex is set so as to lie only slightly inside the foil on the outer or good face of the board. In this manner a 90° V-section cut can be made which allows the end of the board to be folded over with the outer foil intact to form an extremely neat bend.

According to features of this invention the support may be formed basically of a relatively large central part carrying the handle, and two outer wedge blocks each of which is screwed to the central support and forms therewith one of the above-mentioned slots in which one of the blades is clamped. The entire assembly may be made of cast metal or hard synthetic-resin material for relatively low-cost construction. It is also possible to form the central part with a removable piece which allows another blade to be clamped in it at a right angle to the sliding surface underneath the support. This one right-angle blade is used in conjunction with a 45°-inclined blade to form a cut out of right-triangular section. In such an arrangement the combined lower surfaces of all of these parts together form the sliding surface of the tool.

It is also possible according to this invention to form the lower surface by a pair of separate plates which are displaceable parallel to the direction toward and away from the vertex formed by the two blades. These plates may be simple metal profiles bolted to wings on the side of the support and having lower surfaces constituting the sliding surface of the tool. For simplest possible construction the plates are bolted over the blades to the wings of the tools so that they slide parallel to the blades and inner edges of these plates can also constitute support structure for the blades. Screws engaged through slots in the wings into holes in the legs of the plates or vice versa can be loosened so as to allow sliding of these plates parallel to the blades and displacement of the planar lower surfaces thereof forward and away from the vertex formed by the blades.

SPECIFIC DESCRIPTION

Figure 1:
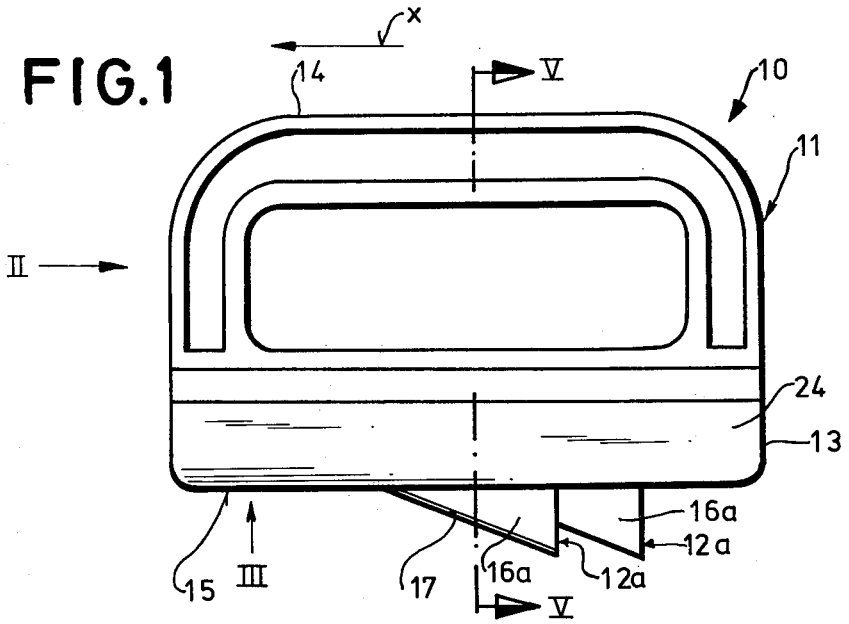
FIG. 1 is a side view of a tool according to this invention.
Figure 2:
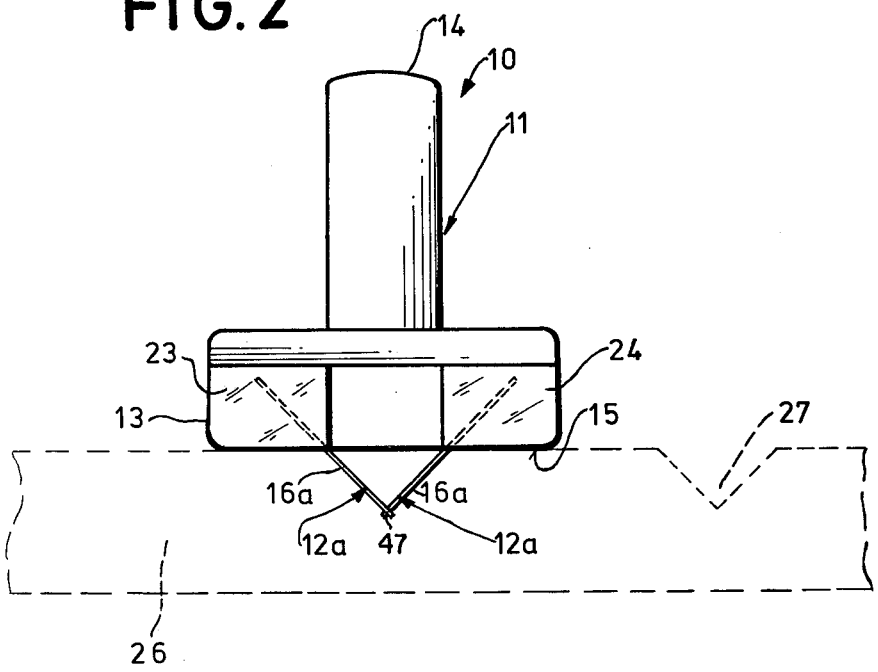
FIGS. 2 and 3 are end and bottom views taken in the direction of arrows II and III, respectively, of FIG. 1.
Figure 3:
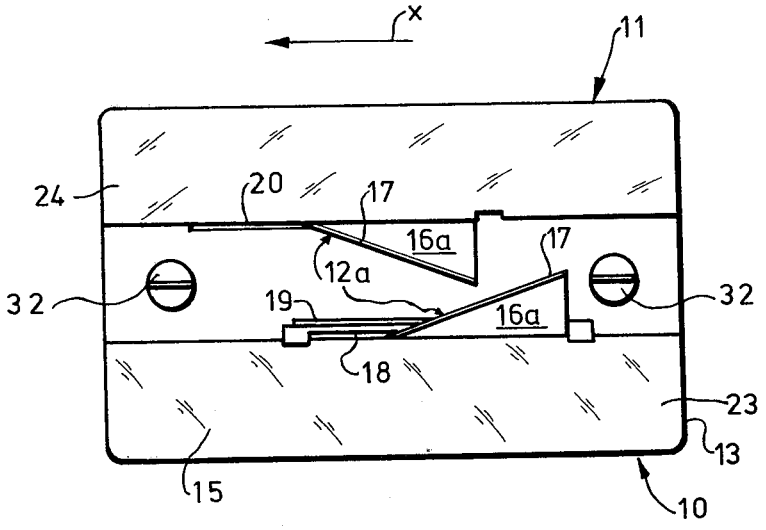

As shown in FIGS. 1–3 a tool 10 according to this invention basically comprises a support 11 formed with a handle 14 and having a base part 13 formed with three coplanar support surface 15 from which extend portions 16*a* of razor-knife-type blades 12*a*. These blades 12*a* have respective cutting edges 17 inclined at angles of approximately 30° to the plane of the base surfaces 15, and the portions 16*a* are staggered in a direction x in which the tool is normally displaced during use. As shown in FIG. 2 the two blades 12*a* are both perfectly planar and lie at angles of 45° to the plane of the surfaces 15 and cross at a vertex 47, overlapping slightly.

When drawn in the direction x through a workpiece such as shown at 26 in FIG. 2 a V-section groove 27 will be formed whose flanks will lie exactly at 90° to each other. The piece excised to form the groove 27 can normally be lifted out after displacement of the tool 10 along the workpiece 26 as a single piece.

Figure 4:
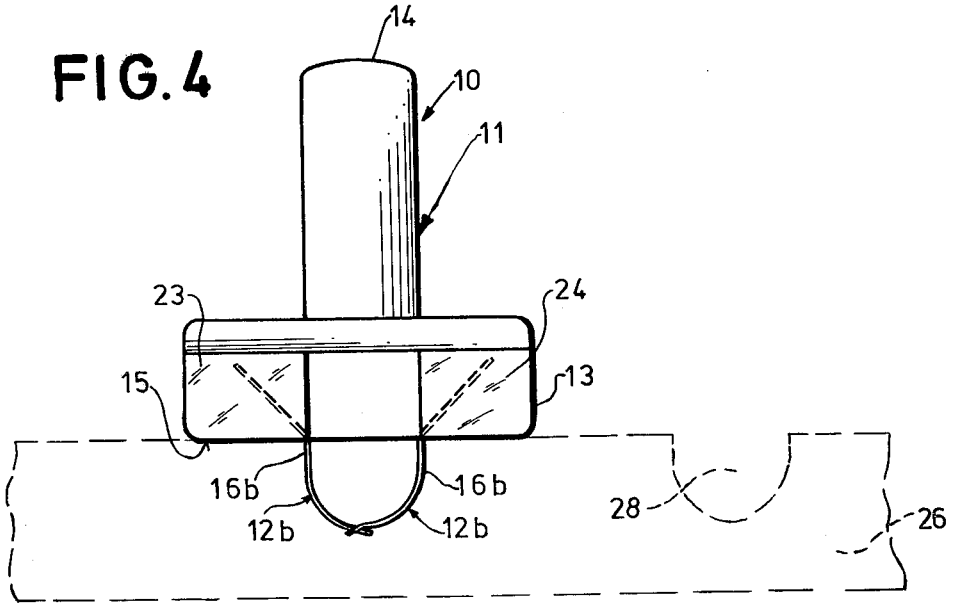
FIG. 4 is a view similar to FIG. 2 showing a variation on the tool of FIG. 1.

FIG. 4 shows another arrangement which is identical except that here blades 12*b* are used having generally semicylindrical lower portions 16*b* so as to form a generally semicylindrical cut out 28 instead of a V-shaped cut out 27. This semicylindrical cut out 28 is particularly useful for installing light plumbing lines or electrical conduit.

Figure 5:
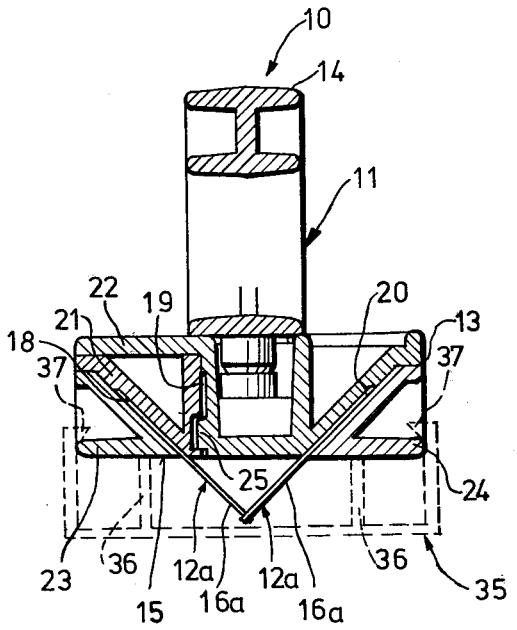
FIG. 5 is a cross-section taken along line V—V of FIG. 1.
Figure 6:
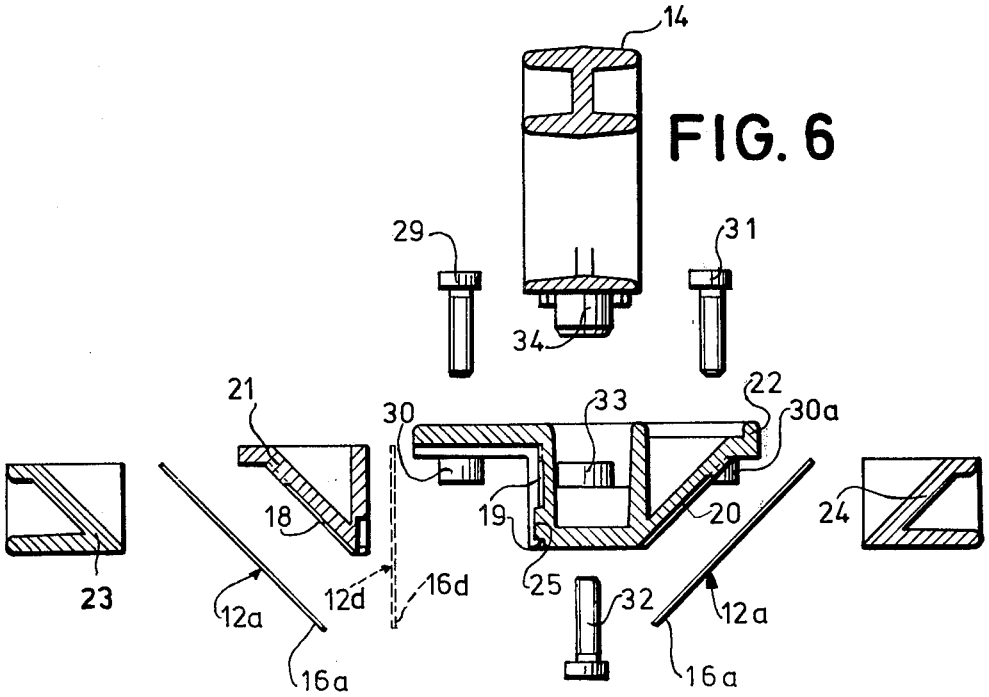
FIG. 6 is a view similar to FIG. 5 but in exploded condition.

FIGS. 5 and 6 show how the tool 10 is constituted in greater detail. The lower portion 13 is formed with three seats or slots 18, 19 and 20. The two slots 18 and 19 extend at angles of 45° to the plane of the surface 15, but the slot 19 extends at an angle of 90° to this plane. The lower portion 13 is formed of a main part 22 that is made symmetrical by addition of a small wedge part 23 to it. The slot 19 for a right angle blade 12*d* is formed between the wedge part 21 and the other part 22 so that a portion 16*d* of this block is exposed. In addition flanking the two parts 21 and 22 us a pair of wedge blocks 23 and 24 which respectively define with the parts 21 and 22 the slots or seats 18 and 20. These blocks 23 and 24 also have planar lower surfaces that constitute the lower face 15 of the tool 10.

FIGS. 5 and 6 further show how a boss 25 on the part 22 and a corresponding recess in the part 21 are provided so that when a blade is fitted into the recess 19 this boss 25 can fit through the hole normally formed through such a blade. Similarly such recesses and bosses are provided between the parts 23 and 21 and between the parts 24 and 22 to hold the blades shown at 12*a* in FIG. 5. The wedge blocks 21 and 23 are secured to the main base part 22 by a screw 29 passing through a counterbored boss 30 in the piece , and also passing through the piece 21 so that it threads into the piece 23 and holds these three elements together. Another such screw 31 passes through the other side of the part 22 at a counterbored boss 30*a* and is threaded into the part 24 to hold it and its blade 12*a* toghtly in place. Finally an upwardly extending and downwardly counterbored boss 33 in the part 22 between the two outer wedge blocks 23 and 24 receives a screw 32 that is threaded into a threaded boss 34 on the bottom of the handle 14. In this manner the entire assembly is held together by three screws so that its assemblyis relatively simple and changing blades is also a very easy task. All of the parts except screws 29, 31, 32 and the blades 12*a* can be made of a strong synthetic-resin material or cast metal such as aluminum.

FIG. 5 also shows how a cover cup 35 has legs 36 which can bear against the surface 35 and other legs having outwardly deflectable formations 37 for engaging over the lips at the bottom edges of the parts 23 and 24. This cover 35 is fitted over the tool 10 when not in use to prevent injury from contact with the naked blades 12*a*.

Figure 7:
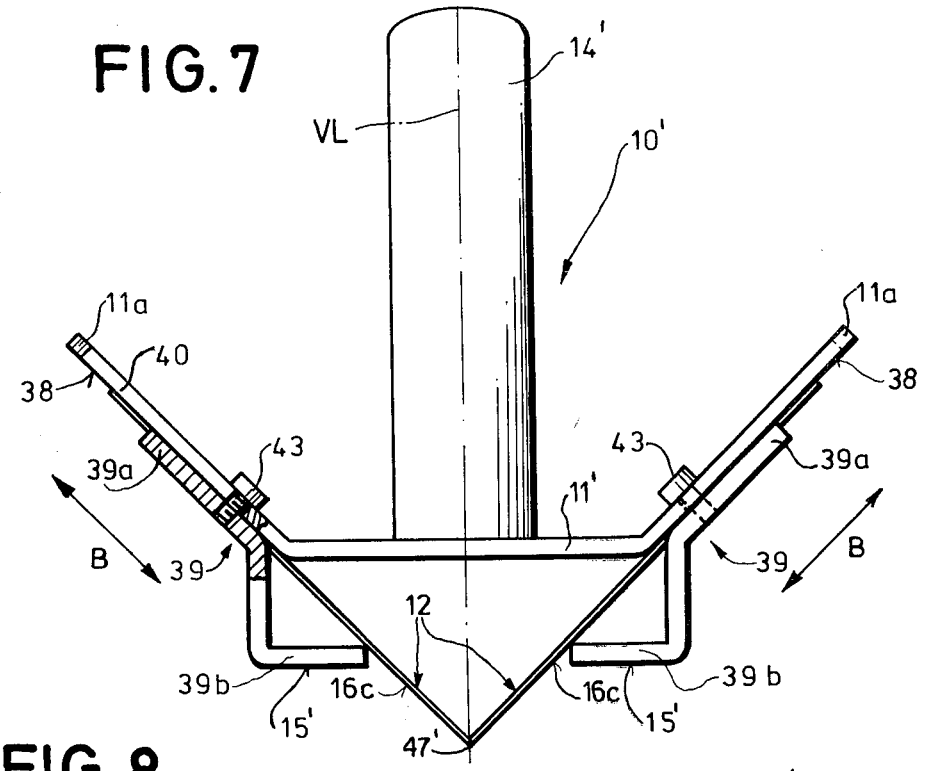
FIGS. 7 and 8 are end and side views, respectively, of another tool according to this invention.
Figure 8:
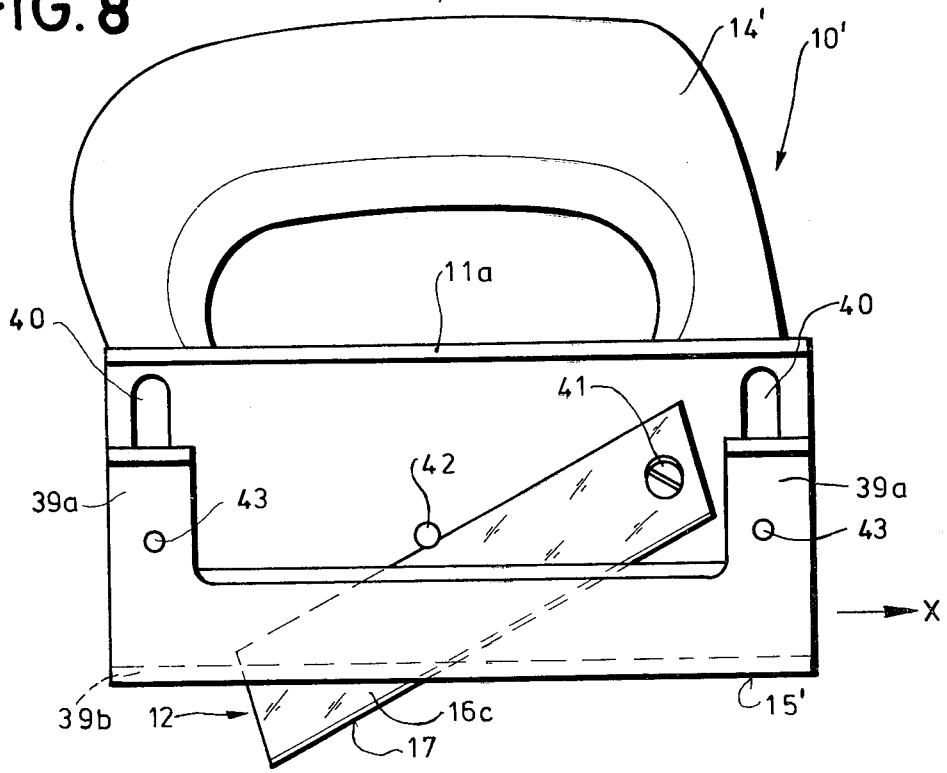
Figure 9:
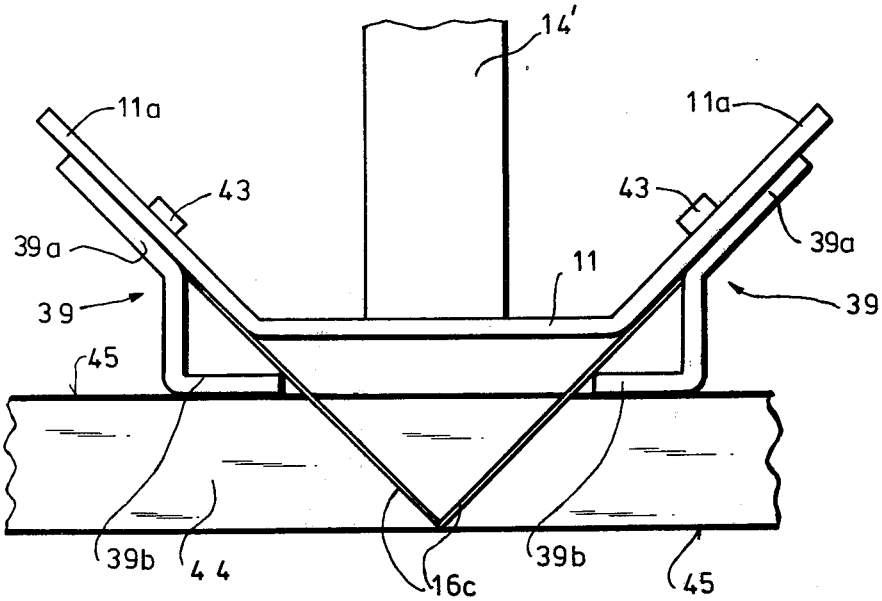
FIG. 9 is a view similar to FIG. 7 but showing a method of using the tool according to this invention.

FIGS. 7–9 show another tool 10' according to this invention having a handle 14' and symmetrical about a plane VL extending in the direction x through the center of the tool. In this arrangement the base 11' is formed of a single piece of flat metal having a pair of upwardly bent wings 11*a* extending at 45° to the plane VL. A pair of blades 12 having exposed portions 16*c* are completely planar and are secured to flat outer and lower surfaces 38 of these wings 11*a*. Holding members 39 are secured to each of these wings 38 over the respective blades 12 and are held thereon by screws 33 passing through slots 40 formed in each of the wings 11*a* and extending in the direction of double-headed arrows B. In addition each blade 12 is secured at its front end at a screw 41 threaded into the respective wing 11*a* and bears at its back edge on an abutment bump 42 also formed approximately in the middle of the respective wing 11*a*. Thus the blades 12 are fixed on the wings 11*a*.

Each of the mounting members 39 has a pair of legs 39*a* each aligned with a respective one of the slots 40 and has a lower plate portion 39*b* forming the respective surface 15'.

With the tool of FIGS. 7–9 it is therefore possible to loosen the screws 43 and displace the members 39 in the direction B to vary the distance between the surfaces 15 and the vertex 47' at which the tips of the blades 12 meet. In this arrangement these tips are set so as to meet and not to pass each other. It is also within the scope of this invention to provide a link between the two members 39 to ensure parallelism of the two surfaces 15'.

It is possible with this type of tool to excise from a workpiece 44 a strip having the section of a right isosceles triangle. This can be done by setting the surfaces 15' so that the distance between them and the intersection point 47 is slightly less than the overall thickness of the workpiece 44 so that the blade portions 16*c* will not cut through the foil 45 on the opposite face of the workpiece.

Figure 10:
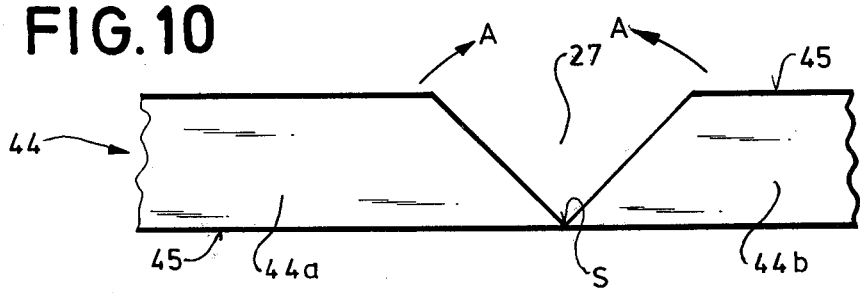
FIGS. 10 and 11 show further methods of using the tool of FIGS. 7–9 for mitering in accordance with this invention.
Figure 11:
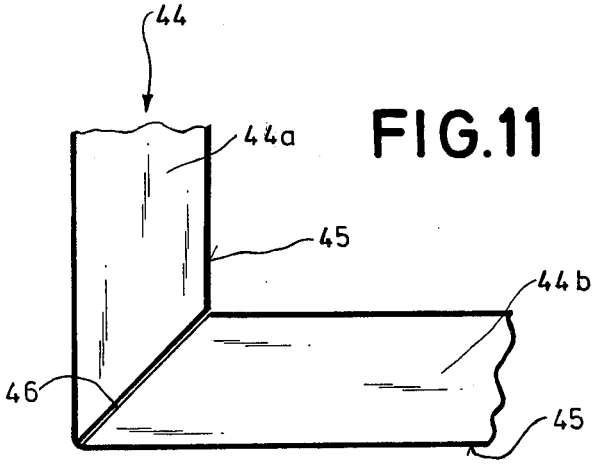

Once a cut such as shown at 27 in FIG. 10 is made it is therefore possible to fold the two workpiece portions 44*a* and 44*b* together as indicated by arrows A so that a fold is formed at S. FIG. 11 shows how the workpiece can thus be bent around a right angle with the outer foil 45 left completely intact. In this manner a very neat mitered edge can be formed without complicated tools.

It is noted that the embodiment of FIGS. 7-9 can be produced at extremely cost. The blades 12 can be of the standard type used in a knife or in a scraper.

The tool according to the instant invention can be used very easily by even a relatively inexperienced worker. If it is necessary to form an exactly straight groove a guide such as a yard stick can be held against the workpiece with the tool run along next to it. When, however, it is only necessary to embed some wiring in the back of an insulating board, it is normally possible to use the tool 10 freehand. Once set for the proper workpiece thickness, it will be impossible for even a completely inexperienced worker to cut completely through the board.

I claim:

1. A grooving tool comprising:

a support forming a substantially planar bearing surface and formed with a pair of generally parallel slots opening at said surface and extending in a predetermined direction, said planar surface being substantially continuous around and between said slots;

a pair of blades staggered in said direction, respectively extending through said slots, and each having a cutting edge inclined to said surface and to said direction;

means for securing said blades on said support with portions of said blades extending beyond said surface and said cutting edges crossing and forming a vertex in projection in said direction on a plane perpendicular to said direction; and a handle on said support, whereby said tool can be displaced in said direction on a workpiece with said cutting edges excising from said workpiece a strip that is held down by said surface between said blades.

2. The tool defined in claim 1, wherein each of said portions is curved.

3. The tool defined in claim 1 wherein said blades are substantially planar except at said portions.

4. The tool defined in claim 1 wherein said blades are substantially completely planar.

5. The tool defined in claim 1 wherein said support is formed with a third such slot parallel to the first- and second-mentioned slots, said third slot being between said first and second slots and formed in such a manner that a blade engaged therein extends substantially perpendicularly to said surface, said first and second slots being formed in such a manner that blades engaged therein extend at acute angles to said surface.

6. The tool defined in claim 1 wherein said support and handle are generally T-shaped seen in said direction with said handle forming the leg of the T.

7. The tool defined in claim 1, further comprising a protective cap engageable over said surface and over said portions.

8. The tool defined in claim 1 wherein said blades are of thin razor-type steel.

9. The tool defined in claim 1 wherein said means for securing includes a pair of wedge blocks on said support forming therewith said slots and respectively clamping said blades against said support.

10. The tool, defined in claim 9 wherein said means for securing includes a pair of screws each engaging between said support and a respective one of said blocks.

11. A grooving tool comprising:

a support forming a substantially flat bearing surface and formed with a pair of generally parallel slots opening at said surface and extending in a predetermined direction;

a pair of blades respectively extending through said slots, staggered in said direction, and each having a cutting edge inclined in said direction and to said surface;

means for securing said blades on said support with portions of said blades extending through said slots beyond said surface and said cutting edges forming a vertex in projection in said direction on a plane perpendicular to said direction;

means on said support for setting said bearing surface at any of a plurality of spacings from said vertex and including at least one plate forming said surface, means for displacing said plate toward and away from said vertex and thereby varying said spacing, and a air of legs on said plate bearing respectively against said blades and slidable therealong, each leg having an edge continuously bearing transversely to said direction on the respective blade; and a handle on said support, whereby said tool can be displaced in said direction on a workpiece with said cutting edges excising a strip from said workpiece.

12. The tool defined in claim 11 wherein said blades are each inclined at between 40° and 50° to said bearing surface.

13. The tool defined in claim 11 wherein said means on said support includes a respective leg on said support each flatly engaging a respective one of said legs of said plates and each forming with the respective leg of the respective plate a leg pair, said means on said support further including a screw threaded into one of the legs of each of said leg pairs and bearable on the other leg of each leg pair for clamping same together.

* * * * *